United States Patent [19]

Holland

[11] Patent Number: 4,923,055

[45] Date of Patent: May 8, 1990

[54] SAFETY MECHANISM FOR PREVENTING UNINTENDED MOTION IN TRACTION ELEVATORS

[75] Inventor: Gordon A. Holland, DeSoto County, Miss.

[73] Assignee: Delaware Capital Formation, Inc., Wilmington, Del.

[21] Appl. No.: 301,190

[22] Filed: Jan. 24, 1989

[51] Int. Cl.[5] ..... B66B 5/02

[52] U.S. Cl. ..... 187/109; 187/89; 187/105; 188/171

[58] Field of Search ..... 187/105, 108, 109, 89; 188/166, 170, 171

[56] References Cited

U.S. PATENT DOCUMENTS

| | | | |
|---|---|---|---|
| 1,114,180 | 10/1914 | Pearson | 187/109 |
| 1,444,614 | 2/1923 | Kimball | 187/109 |
| 2,238,622 | 4/1941 | Borland | 187/105 |
| 2,914,138 | 11/1959 | Borden | 187/108 |
| 4,257,494 | 3/1981 | Frankel | 187/89 |
| 4,306,637 | 12/1981 | Keiser et al. | 188/170 |
| 4,531,617 | 7/1985 | Martin et al. | 187/89 |

*Primary Examiner*—A. D. Pellinen
*Assistant Examiner*—W. E. Duncanson, Jr.
*Attorney, Agent, or Firm*—White & Case

[57] ABSTRACT

A traction elevator includes a safety mechanism for preventing unintended motion of the car. A trigger, when armed, is positioned in the path of bosses on the drive sheave or another sheave, such that any unintended rotation of the sheave causes actuation of the trigger and the consequent tripping of an emergency brake. Preferably, the trigger is armed whenever the car is stopped at a landing, and is also selectively armed responsive to elevator overspeed detection.

33 Claims, 11 Drawing Sheets

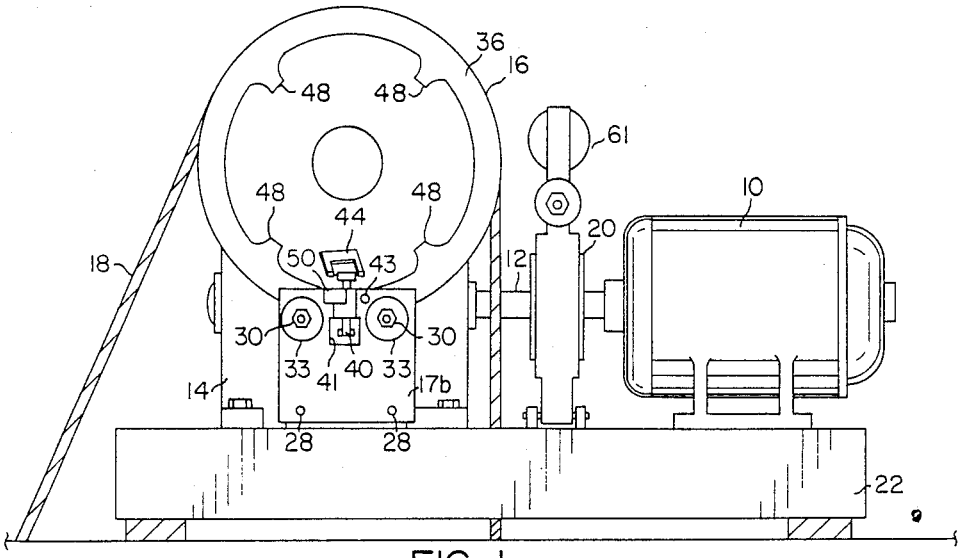
FIG. 1
FIG. 2
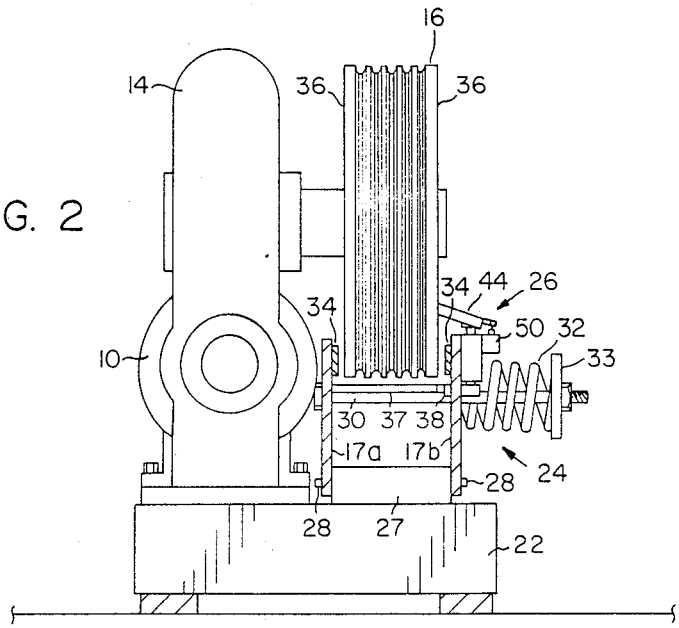

94(WHEEL)
90
96
94
44
46
92
50
42
40
154
153
152
151
100
TRIP MECHANISM
62
GOV. SW.
104
101
A
98
GOV. ROPE
MOVEABLE JAW
FIXED JAW

SAFETY MECHANISM FOR PREVENTING UNINTENDED MOTION IN TRACTION ELEVATORS

BACKGROUND OF THE INVENTION

The present invention is an improved safety mechanism for geared and gearless traction elevators, which can effectively prevent runaway motion of the car in both the up and down directions, and which can also prevent any unwanted car movement at a landing.

A traction elevator has a car supported by a plurality of ropes, which pass over a drive sheave at the top of the elevator shaft and are connected to a counterweight. Long ago, the elevator car safety was developed to prevent elevator cars, in the event of a rope breakage or other mishap, from falling down the elevator shaft. Typically, the car safety is activated by a governor driven by a cable attached to the car.

The hoist machine, located at the top of the elevator shaft, has a motor for driving the drive sheave to move the car up and down, and a main friction brake to hold the car while parked at landings, when the motor is off. The friction brake is needed because the weight on opposite sides of the drive sheave is usually not equal. The friction brake, which is typically spring-applied and electrically released, is designed to hold any unbalance, ranging from that of an empty car on a high floor to that of a car on a low floor with a 25% overload.

There are several conditions under which the friction brake can fail, however. The brake spring compression may have been misadjusted to produce a "soft" stop in normal operation. The brake linings may have become worn, which will reduce the spring pressure. The brake linings may become contaminated with oil, thereby reducing the coefficient of friction. Or, the brake-release solenoid or other parts could jam or otherwise fail to let the brake apply.

If the brake should fail at a landing, and the car begins to move, the releveling circuit should actuate the motor to keep the car relatively close to the landing. However, there are conditions under which the motor control can malfunction or not be actuated (e.g. a safety shutdown or power failure). Moreover, the motor could disengage from the drive sheave, as a consequence of a broken worm or pinion shaft or broken gear teeth (in the case of a geared elevator).

In the event of a failure while the doors are closed, unwanted car movement in the down direction generally presents only limited consequences, due to the presence of the traditional car safety. If the movement commences sufficiently close to the bottom of the shaft, and the car reaches the car buffer before tripping the governor, the buffer will decelerate the car at a rate less than one "g". If the car reaches the trip speed of the governor, then the car safety will stop the car, and again the deceleration provided by the car safety will be less than one "g".

The typical elevator counterweight is designed to balance the weight of the car plus about 40% of the rated car capacity. In practice, at least 75% of elevator trips are made with less than 40% of rated capacity on board. This means that, in the event of a failure, the car will more often move in the up direction, due to the counterweight side being heavier than the car side.

The existing Elevator Code (Safety Code For Elevators and Escalators) prohibits setting the car safety in the up direction. A small percentage of elevators have counterweight safeties, but for the majority of elevators, if runaway upward travel should occur, the car will continue to accelerate until the counterweight eventually strikes its buffer, possible at a speed far in excess of the rating of the buffer. But, no matter how quickly the downwardly-moving counterweight is stopped, the car will keep going, decelerating only due to gravity, i.e., at one "g". If the overhead clearance is insufficient for the car to stop due to the deceleration of gravity, the car will strike the slab or other obstruction at the top of the hoistway, causing damage and possible injury.

When the car is at a landing with the doors open, any motion of the car, except for a releveling operation, is unintended. Yet, in the event of a failure as described above, even if the car has both a car safety and a counterweight safety, there is nothing to arrest car movement, either up or down, until overspeed conditions are reached or the buffer is hit.

SUMMARY OF THE INVENTION

The present invention is a safety mechanism for preventing unintended motion in traction elevators, that is, preventing overspeed in the up or the down direction, or preventing unintended car motion when the car is at landings. Preferably, the safety mechanism is employed to prevent unintended motion under all three conditions.

More particularly, a traction elevator includes a car, a main friction brake for holding the car at landings, at least one sheave rotated responsive to movement of the car, and at least one additional emergency brake. The emergency brake includes a catch for retaining the brake in a disengaged position, and a tripping mechanism that includes a trigger that is selectively armed and tripped whenever inappropriate motion of the car occurs (e.g. overspeed or while the car is stopped at a landing). The trigger is armed by pivoting it into the path of bosses on the sheave. Any unwanted rotation of the sheave will actuate the trigger to release the catch and actuate the emergency brake.

In one embodiment, the emergency brake includes a pair of spring-loaded caliper plates, having brake pads that engage the end faces of the drive-sheave or, alternatively, a separate brake disc on the drive sheave The trigger is pivotably mounted on the upper end of a trigger shaft which is connected to a brake release cam. The trigger is normally armed, so as to be in the path of bosses formed on the inside rim of the drive sheave, but is pivoted by a solenoid or any other appropriate actuator to a disarmed position when the car is about to start an up or down run.

The trigger solenoid is preferably energized, disarming the trigger, by the main brake energization circuit (energization of the main brake release solenoid indicating that car movement is intended). Preferably, energization of the trigger solenoid may be overridden either electrically (by a switch in series with the trigger solenoid) or mechanically responsive to an overspeed governor of the car, so as to arm the trigger and trip the emergency brake.

During normal operation, the trigger will be armed while the car is at a landing, but will not trip the emergency brake. When the car is ready for a run, the trigger will be disarmed (simultaneous with the energization of the main brake) before the car starts to move. If the drive sheave should rotate at a landing while the trigger is armed, the trigger is actuated, tripping the emergency brake, before any significant car movement occurs.

During a car run, if overspeed occurs, the trigger solenoid is either de-energized or mechanically disengaged from the trigger. The trigger will thereby drop into the path of the rotating bosses, causing actuation of the emergency brake.

An alternative embodiment of the invention includes a trigger mechanism as described above, which may be selectively armed and, while armed, is actuated by sheave rotation, but which is coupled to an existing safety brake of the elevator (either the car safety, the counterweight safety, or both, a device such as a rope brake of the type which clamps the hoist or compensating ropes, or any other type of trip release emergency device) Preferably, the governor sheave is provided with one or more bosses, and the trigger is armed by being rotated into the path of bosses on the governor. The trigger is then mechanically coupled to the governor trip mechanism.

The safety mechanism according to the invention is simple and rugged in construction and is effective even if the gearing becomes disengaged. The mechanism has no effect on normal operation of the elevator and is therefore not prone to misadjustment. It can be pinned or sealed in the factory.

The preferred embodiments of the invention will be described with reference to the accompanying figures.

BRIEF DESCRIPTION OF THE DRAWINGS

FIG. 1 is an elevational view of a geared elevator hoist machine including a first embodiment of a safety mechanism according to the invention;

FIG. 2 is the side elevation, partially in section, of the machine of FIG. 1, with the hoist ropes omitted for clarity;

DETAILED DESCRIPTION OF THE PREFERRED EMBODIMENTS

Figure 3:
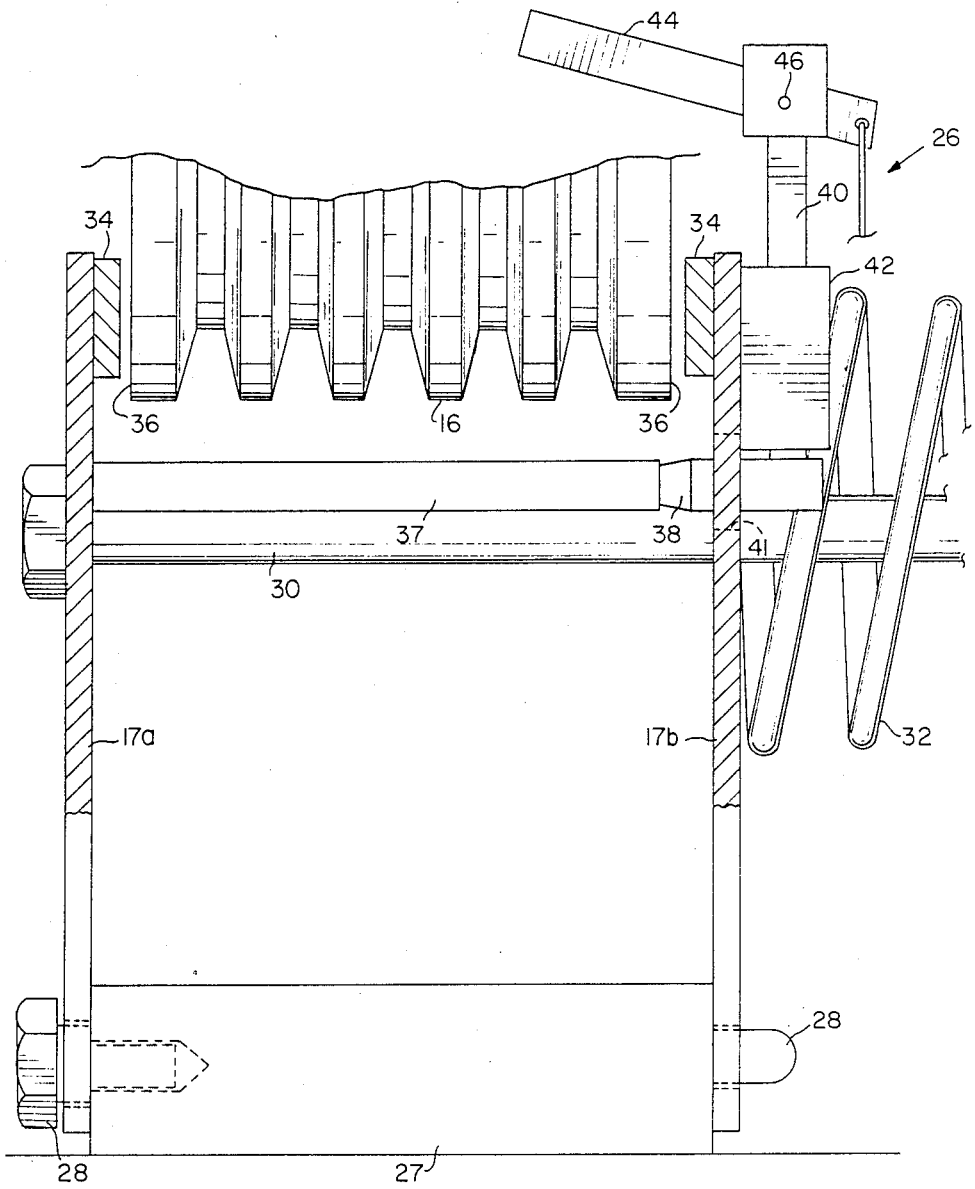
FIG. 3 is a side view, on an enlarged scale, of the safety mechanism of the embodiment of FIGS. 1–2.

FIGS. 1 and 2 illustrate a geared elevator hoist machine having a motor 10, which is connected through shaft 12 and gearbox 14 to the main drive sheave 16. A plurality of ropes 18 pass over drive sheave 16. The ropes 18 may optionally pass over an idler sheave 15, and opposite ends of the ropes support the elevator car 11 and counterweight 13 (see FIG. 10*a*) in a known manner. An electrically operated main friction brake 20 engages the input shaft 12, and is used for preventing rotation of the shaft 12 when the motor 10 is off, i.e., when the car is stopped at a floor. A bedplate 22 supports the hoist machine components and is customarily mounted to the building at the top of the hoistway shaft.

In addition to the foregoing conventional components, an elevator according to the invention includes a novel safety mechanism, a first embodiment of which will be described in connection with FIGS. 1–3. The safety mechanism, which is described further below, includes a spring-loaded brake assembly 24 and a tripping mechanism 26.

The brake assembly 24 includes a pair of caliper plates 17*a*, 17*b*, disposed on either side of the drive sheave 16. The plates are spaced apart at their lower ends by a base 27 and held by pivots 28, which may be shoulder bolts. The bolts 28 extend through clearance holes in the plates 17*a*, 17*b* and hold the plates to the base loosely so as to take the reaction from the brake when it is applied to the sheave, but provide clearance to allow the plates a small degree of freedom to pivot between the "brake released" and "brake applied" positions, as described below.

In the upper portion of plates 17*a*, 17*b*, a pair of spring rods 30 are attached to plate 17*a* and extend through plate 17*b*. A pair of springs 32 are disposed about the rods 30, between caliper plate 17*b* and end plates 33, so as to urge the plates 17*a*, 17*b* toward one another. Brake linings 34 on the upper end of the plates frictionally engage end surfaces 36 of the sheave 16 when urged together by springs 32.

As shown more clearly in FIG. 3, the plates are normally held apart by a releasible catch mechanism. A spreader bar 37 is attached to one of the plates 17*a* and extends toward the second plate 17*b*. A brake release cam 38, which is attached to trigger shaft 40, extends through a slot 41 in the second plate 17*b* into engagement with the spreader bar 37 to keep the plates 17*a*, 17*b* apart. The trigger shaft 40 is, in turn, rotatably secured in a bearing block 42 attached to the second plate 17*b*.

The tripping mechanism 26 includes a trigger 44, a plurality of cooperating bosses 48 on the inside rim of the drive sheave, and a solenoid 50. The trigger 44 is attached to the trigger shaft 40 in a torsion resistance manner about the vertical axis of the shaft 40, so that rotation of the trigger 44 about the shaft axis causes the shaft 40 to turn, and is pivotably mounted to the shaft 40 about a horizontal axis, through pivot shaft 46. Solenoid 50 is coupled to the trigger for pivoting the trigger between an "armed" position, in which the trigger is in the rotational path of the bosses 48, and a "disarmed" position (shown), in which the trigger 44 is moved out of the rotational path of the bosses 48. Preferably the trigger is disarmed only when the solenoid is energized, and falls to the armed position due to gravity when the solenoid is not energized, so as to provide fail safe operation.

The drive sheave is conventional except for the addition of bosses 48 on the inside surface of the rim. These bosses may be part of the casting, and do not need to be machined.

When the brake release cam 38 is in the position shown in FIG. 3, the brake pads 34 remain apart. Should the sheave 16 rotate while the trigger 44 is armed, the bosses 48 will rotate the trigger 44 about the shaft axis, causing the cam 38 to rotate out of engagement with the spreader bar 37. The springs 32 will then force the caliper plates 17*a*, 17*b* toward one another, and cause the brake pads 34 to engage the end faces 36 of the sheave 16.

Figure 4:
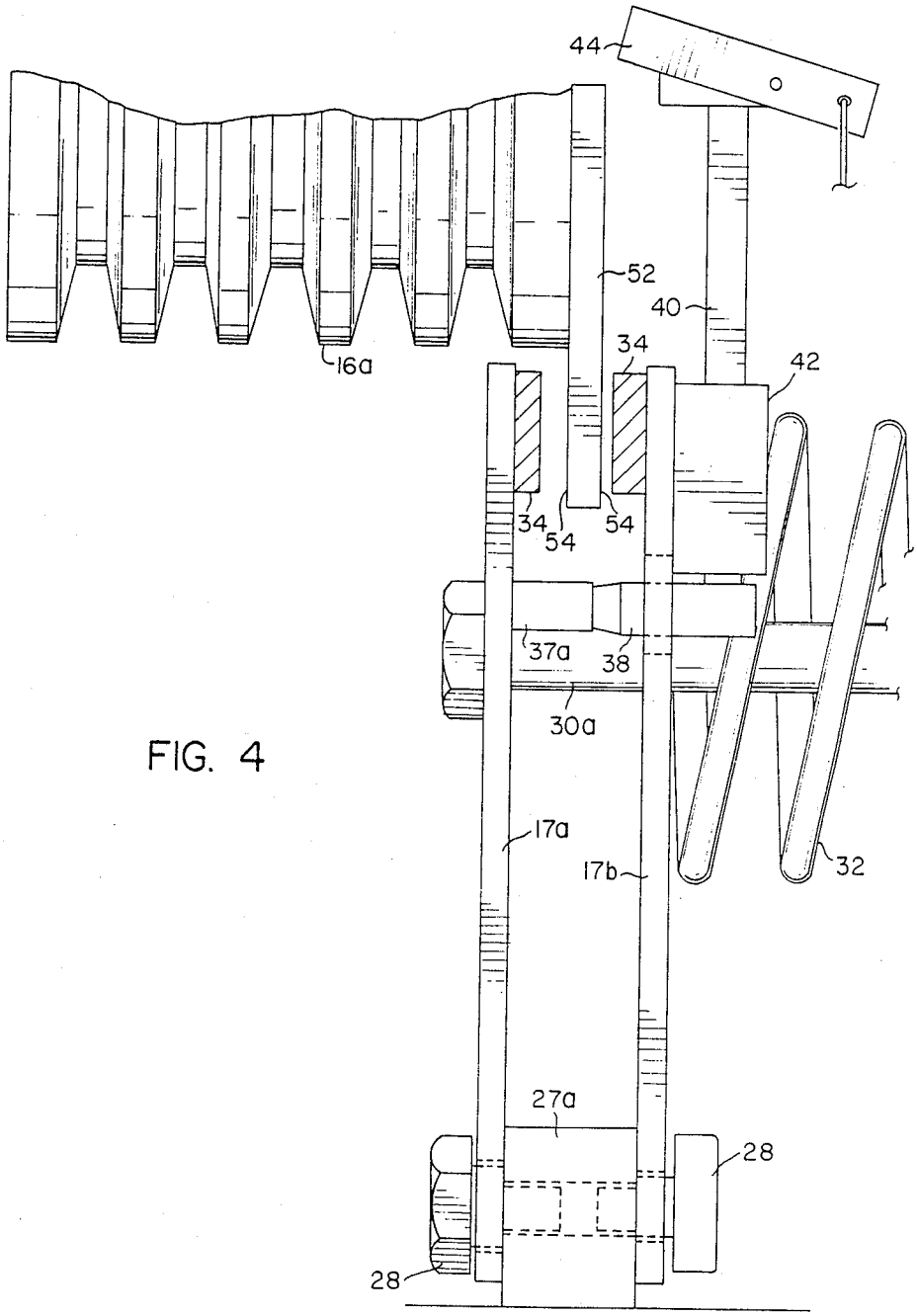
FIG. 4 is a side view of an alternate embodiment of a safety mechanism according to the invention, employing an emergency disc brake.

FIG. 4 shows an alternative brake embodiment, in which the sheave 16*a* is cast with a disc 52 for providing disc brake surfaces 54. Alternatively, a disc plate can be formed separately and bolted or otherwise attached to sheave 16. As in the case of FIGS. 1–3, a pair of caliper plates 17*a*, 17*b*, with brake pads 34, are pivotably held at their lower ends by shoulder bolts 28, against base 27*a*, and are biased toward one another at their upper ends by springs 32 and spring rods 30*a*. The plates are held open by a catch mechanism in the form of a spreader bar 37*a* and a cam 38. The trigger 44 and connecting shaft 40 are the same as in FIGS. 1–3.

In the case of FIGS. 1–3 and 4, the springs may apply a force of several thousand pounds to the cam 38, which will require a substantial tripping force. However, because the trigger 44 mechanically engages the drive sheave 16, in the event of unintended car movement the entire force and momentum of the car movement is available to act on the trigger, assuring sufficient tripping force (if the car imbalance is not enough to actuate the trigger, the car cannot move).

As shown in FIG. 1, a tapped hole 43 is provided in the upper portion of one of the plates, e.g. 17*b*. To set the brake, a threaded rod may be screwed into the hole 43. The rod will impinge on the drive sheave rim, to force the plates 17*a*, 17*b* apart. With the plates apart, the release cam 38 is rotated so as to be centered on the spreader bar 37 or 37*a*. The rod can then be removed. The springs 32 will cause the plates 17*a*, 17*b* to center about the sheave flanges to give running clearance between both lining pads 34 and the sheave 16 or disc 52. Preferably, the hole 43 is aligned with the end face 36 of the sheave 16, so that the rod engages the sheave 16 and cannot inadvertently be left in place after setting the catch.

Figure 5:
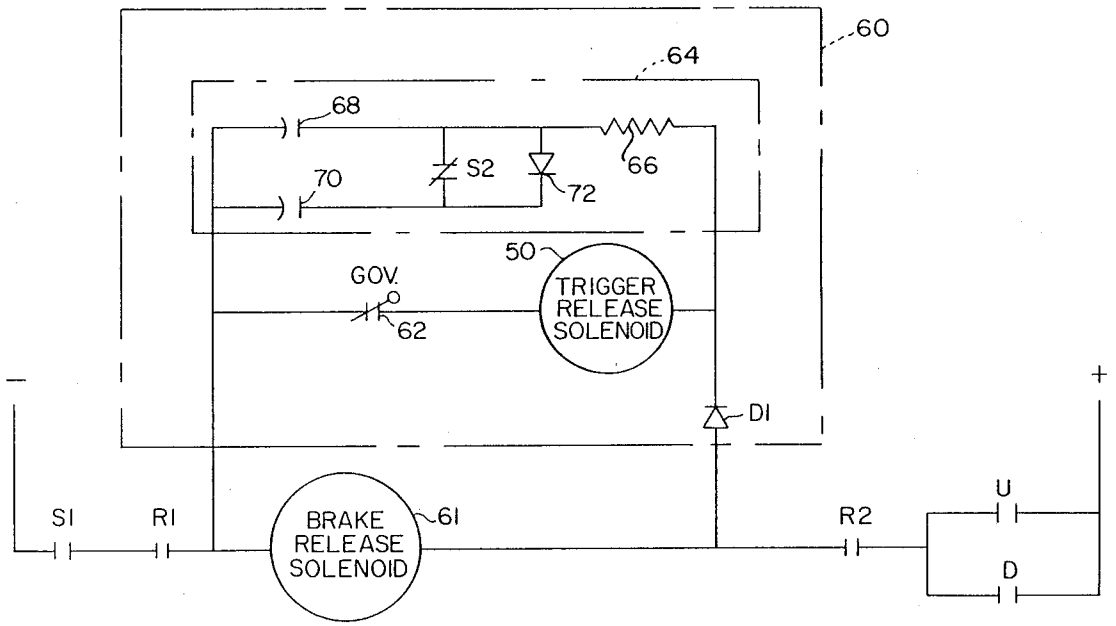
FIG. 5 is a schematic diagram of a circuit for arming and disarming the safety mechanism shown in FIGS. 1–4 or 5.

The trigger 44 is controlled so as to be armed under elevator operating conditions where car movement is not desired, and disarmed when car movement is intended so as not to interfere with normal elevator operation. FIG. 5 illustrates an example of a control circuit 60 for controlling the operation of the solenoid 50 in such manner. FIG. 5 also illustrates a portion of an electrical circuit for actuating the main friction brake release solenoid 61. "U" and "D" represent the up and down relay contacts, which are closed for up and down runs, respectively. Run delays "R1", and "R2" are closed for any intended motion, up or down. Normally open safety relay "S1" is opened in the event of an elevator malfunction. Brake release circuits of this type are well known and need not be described further here.

The control circuit 60 includes solenoid 50, which is wired in parallel with the brake release solenoid 61, and which may also be wired in series with a governor switch 62, which is connected to the car governor. The solenoid 50 and governor switch 62 are, in turned, wired in parallel to a time delay circuit 64, which includes a resistor 66 in series with a pair of parallel capacitors 68, 70. Capacitor 70 is connected to resistor 66 through two parallel circuits, one containing diode 72 which allows the capacitor 70 to charge but prevents reverse current flow toward the resistor 66, and the other containing normally closed safety relay S2.

In operation, the trigger 44 is armed, by deenergizing the emergency brake solenoid, at times when the motion of the elevator car is not intended. The control circuit of FIG. 5 acts to arm the trigger under two conditions: during overspeed, and when no motion is intended at all.

Operation When No Motion is Intended

Referring to FIG. 5, as the car begins a run, the main brake release solenoid 61 is actuated, releasing the brake 20. At the same time, the trigger release solenoid 50, which is in parallel with the brake solenoid, is energized, so that the trigger 44 is moved upwardly to its disarmed position. The car can then execute a normal run without tripping the emergency brake 24.

As the car comes to a stop at the target floor, current to the main brake solenoid 61 is de-energized by opening of the contacts R1, R2, and either U or D, causing the elevator brake 20 to engage. Current to the trigger release solenoid 50 is simultaneously interrupted, but energy stored in the capacitor 68 will delay the drop out of the trigger release solenoid 50 for a predetermined time to assure that the elevator is at a full stop before the trigger 44 drops. The diode D1 prevents the discharge current from capacitor 68 from flowing through the brake solenoid. Under normal run conditions safety relay contact S2 is open, and diode D2 prevents the capacitor 70 from discharging to the trigger release solenoid, so that the time delay is determined solely by capacitor 68 and resistor 66.

Once the current from capacitor 68 has sufficiently decayed, the trigger 44 will drop into the path of the bosses 48, and will be struck by a boss if the sheave 16 should rotate. If the trigger 44 drops on top of a boss 48, it does not prevent operation since any sheave motion will allow the trigger to drop fully to engage the next boss.

A switch 21 (manual reset type) is opened when the trigger is tripped. The switch is wired into the "safety circuit" of the elevator control to de-energize the motor at the instant the emergency brake was applied.

Operation During Overspeed (Governor Actuation)

Conventional elevator governors include a switch which is actuated responsive to overspeed of the elevator car in either direction. As shown in FIG. 5, the trigger release solenoid is wired so as to be in series with a governor overspeed switch 62 which opens at overspeed conditions. Upon opening of the contact 62, the trigger 12 is dropped into the path of the rotating bosses 48. A boss will collide with the trigger 44, causing shaft 40 to rotate, moving the release cam 38 out of alignment with the spreader bar 37, and allowing the springs 32 to force the brake linings 34 against the sheave flanges 36 (or disc surfaces 54). Arming of the trigger 44 (by de-energizing the solenoid 50) is not delayed by the time delay circuit 64.

As noted above, during a normal stop at a landing, with the safety circuit closed (as indicated by contact S2 being open), a time delay is provided by capacitor 68, e.g. of one or two seconds. If the safety circuit opens at high speed, it is desirable to delay the actuation of the emergency brake until the main friction brake can stop the car. In the circuit of FIG. 5, if the safety circuit is actuated, relay contact S1 opens and relay contact S2 closes. The timing function is now provided by both capacitors 68 and 70 and will provide a longer delay, e.g. five or six seconds, before the trigger solenoid 50 is deenergized. This gives the car time to stop completely before dropping the trigger and prevents unnecessary tripping of the emergency brake.

The timing of the delay circuit 64 is not critical so long as it exceeds the maximum stopping time during an emergency stop. Moreover, although the emergency brake is not armed for, e.g. 2 seconds after the car makes a normal stop at a landing, safety is not compromised since the car will be held close to the landing by the leveling function even if the conventional brake has failed. The emergency brake will protect against a subsequent loss of control such as the loop overload tripping, the MG set shutting down, a power failure, suicide circuit failure or drive failure, etc.

The safety mechanism has no effect on the normal operation of the elevator. Also, because the brake assembly is utilized only in emergencies, it is not prone to wear or misadjustment.

When a brake or a safety is designed to work in the down direction, it must consider not only the rated load of the elevator but the possibility of the car being overloaded. The elevator code requires most tests to include 125% of rated load. The other design consideration for a safety is whether the ropes are intact or it is a free-fall. These considerations make the design very difficult since any braking force that is adequate for the "worst case" free-fall is too much force for the other cases.

This is not the case for a brake designed to work in the up direction since the car can only "fall up" when the load in the car is less than the balance load (40% of rated), and the worst case is an empty car; there is nothing "below empty" that is an equivalent to an overloaded condition in the down direction. There is also no consideration given to "ropes parted" since the counterweight cannot pull the car upwards unless the ropes are intact.

In the emergency brake according to the invention, the braking force can be chosen so as to give safe but gentle braking at any load from empty car to balanced load. The braking may be inadequate to cause a full deceleration and stop in the down direction during overload or free fall, but it does not matter since there is a safety available in the down direction and thus it is not necessary to rely on the emergency brake as the sole back-up to the conventional brake. The emergency brake can prevent acceleration in the down direction even if its braking force is inadequate to produce a full stop.

FIGS. 6–9 disclose an alternative embodiment of a safety mechanism which is mechanically actuated on overspeed conditions.

Figure 6:
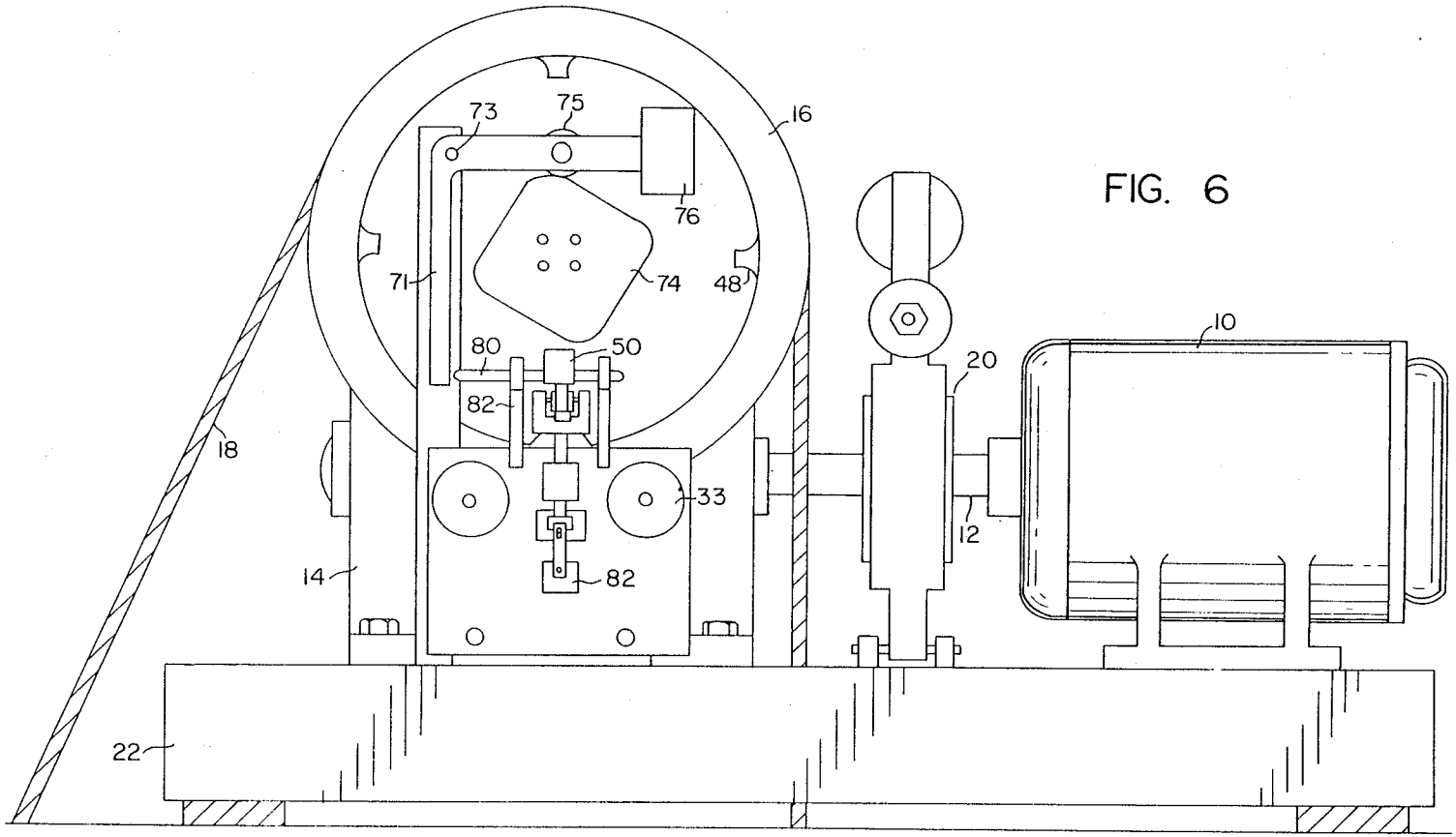
FIG. 6 is an elevation view of a geared elevator hoist machine including a third embodiment of a safety mechanism according to the invention.

FIG. 6 illustrates a type of governor used in some applications for slow speed elevators. Such a governor is not normally mounted on the drive shaft of a machine, as here, but is a separate device driven by a governor rope trained around a governor sheave in a conventional manner. The shaped cam is rotated about its center at a speed proportional to car speed.

In its application in the present invention, the governor includes an L-shaped oscillating arm 71, pivoted about pivot 73, with a rubber-tired roller 75 which rides on the outside periphery of cam 74 coupled to the drive sheave 16. A weight 76 is mounted on the free end of the arm 71 to urge the roller 75 toward the cam 74. The cam 74 is shaped in such a way that at rated car speed, the roller 75 can keep in contact with the cam as it rotates. At some speed in excess of rated speed, the resulting velocity of the oscillating weight causes the roller to "ski-jump" at the lobe of the cam, and therefore the roller loses contact with the cam, i.e., the amplitude of the oscillation increases beyond that defined by the shape of the cam.

The cam 74 is shown with 4 lobes but can have more or less depending on the rated car speed and the desired "trip" speed of the governor. This type of governor is preferable to the flyweight type because the rpm of the drive sheave is relatively low. This type governor can be designed for a more accurate trip speed at low rpm.

Figure 7:
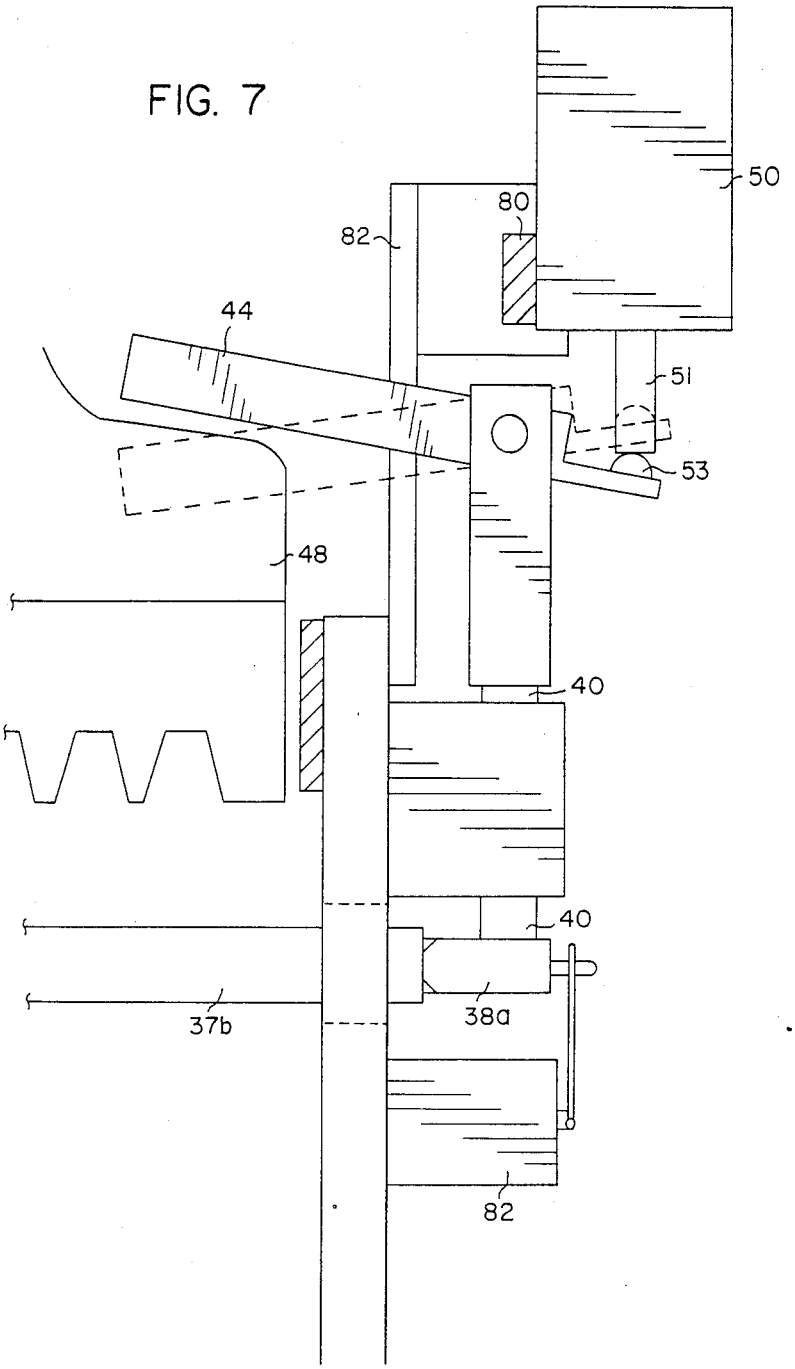
FIG. 7 is a side view of a portion of the safety mechanism of FIG. 6.

As shown in FIG. 7, the trigger 44 is pivotably mounted on trigger shaft 40, about an axis perpendicular to the shaft axis, but in a torsion resistant manner, such that rotation of trigger 44 about the shaft axis, as caused by bosses 48, causes the release cam **38*a* to rotate and disengage from spreader bar 37*b***.

In the embodiment of FIGS. 6–7, the solenoid 50 is mounted on a slideable rod 80, held in supports 82. One end of the rod 80 is aligned with the L-shaped arm 71. The solenoid is normally positioned at a first location where plunger 51 engages a knob or rivet head 53 on trigger 44, to selectively pivot the trigger to the disarmed position. Should governor overspeed occur, and roller 75 move off cam 74, the arm 71 will strike slideable rod 80, displacing solenoid 50 to a second location where plunger 51 is out of engagement with knob 53, causing the trigger 44 to drop to the armed position.

Figure 8:
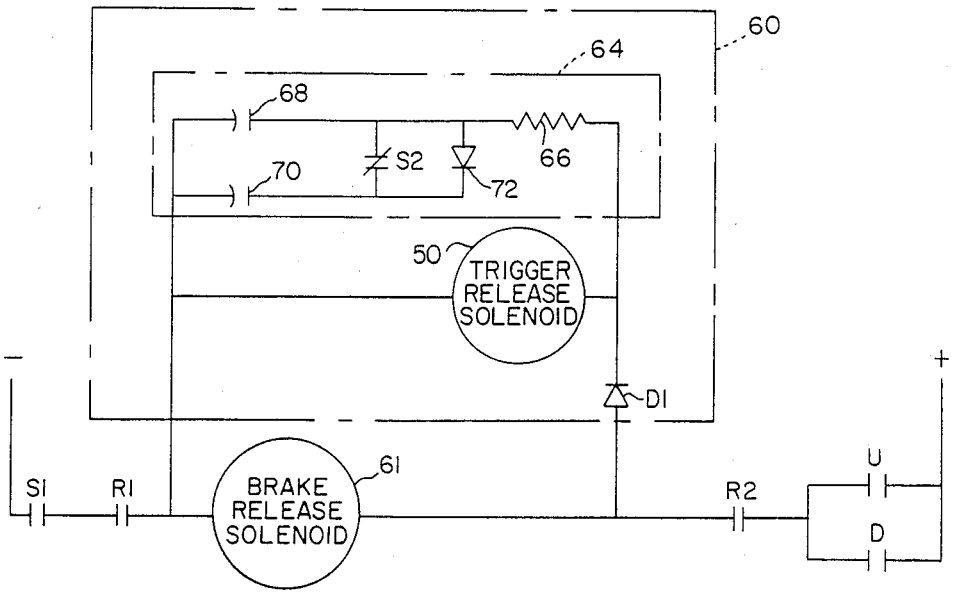
FIG. 8 is a schematic diagram of a circuit for arming and disarming the safety mechanism of FIGS. 6–7.

FIG. 8 illustrates a control circuit for actuating the trigger release solenoid 50 of FIGS. 6–7. The circuit is the same as FIG. 5 except that, because the solenoid 50 is mechanically disengaged during overspeed, the governor switch 62 of FIG. 5 is not needed.

A switch 82 (manual reset type) is opened when the brake release cam **38*a* and shaft 40 are turned. The switch 82** is preferably wired into the safety circuit of the elevator control to de-energize the motor at the instant the emergency brake was applied.

Operation

For normal car runs, the embodiment of FIGS. 6–8 operates the same as FIGS. 1–5. When the main friction brake solenoid is energized, the solenoid 50 is energized. As shown in FIG. 7, the energized solenoid plunger 51 moves to the extended position (downwards), to impinge on the knob 53 and hold the trigger in the retracted position. When the car comes to a stop, the de-energized solenoid 50 will, after the time delay produced by capacitor 68 and resistor 66, drop the trigger 44 to the armed position.

During car motion, the roller 75 rides on the surface of the cam 74, and the arm 71 oscillates. The bottom end of the L-shaped arm 71 also oscillates in an arc about the pivot 73. During rated speed operation, the bottom end of arm 71 does not contact bar 80. If overspeed occurs, the roller "ski-jumps" and the oscillation amplitude increases. The bottom end of arm 71 will strike bar 80 and push it, and the solenoid 50 which is mounted on it, to the right. The solenoid plunger 51 will be moved out of alignment with the spherical rivet head, causing the trigger to drop into the path of the bosses.

In the embodiment of FIGS. 6–8, the trigger 44 is electrically actuated in connection with its function of preventing unintended motion at landings. However, the emergency brake operation during overspeed is strictly mechanical since it neither relies on the operation of the solenoid, nor is prevented from functioning by a failure of the solenoid.

Figure 9B:
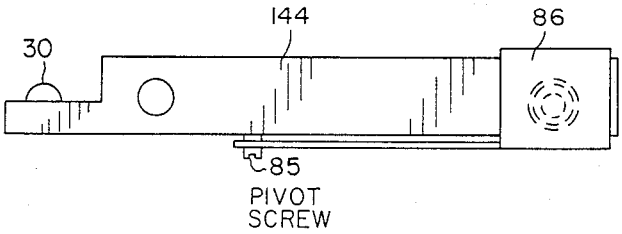
FIG. 9*b* and 9*c* are side and front views, respectively, of the trigger of the FIG. 9*a* safety mechanism.
Figure 9C:
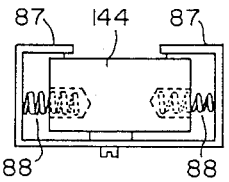
Figure 9A:
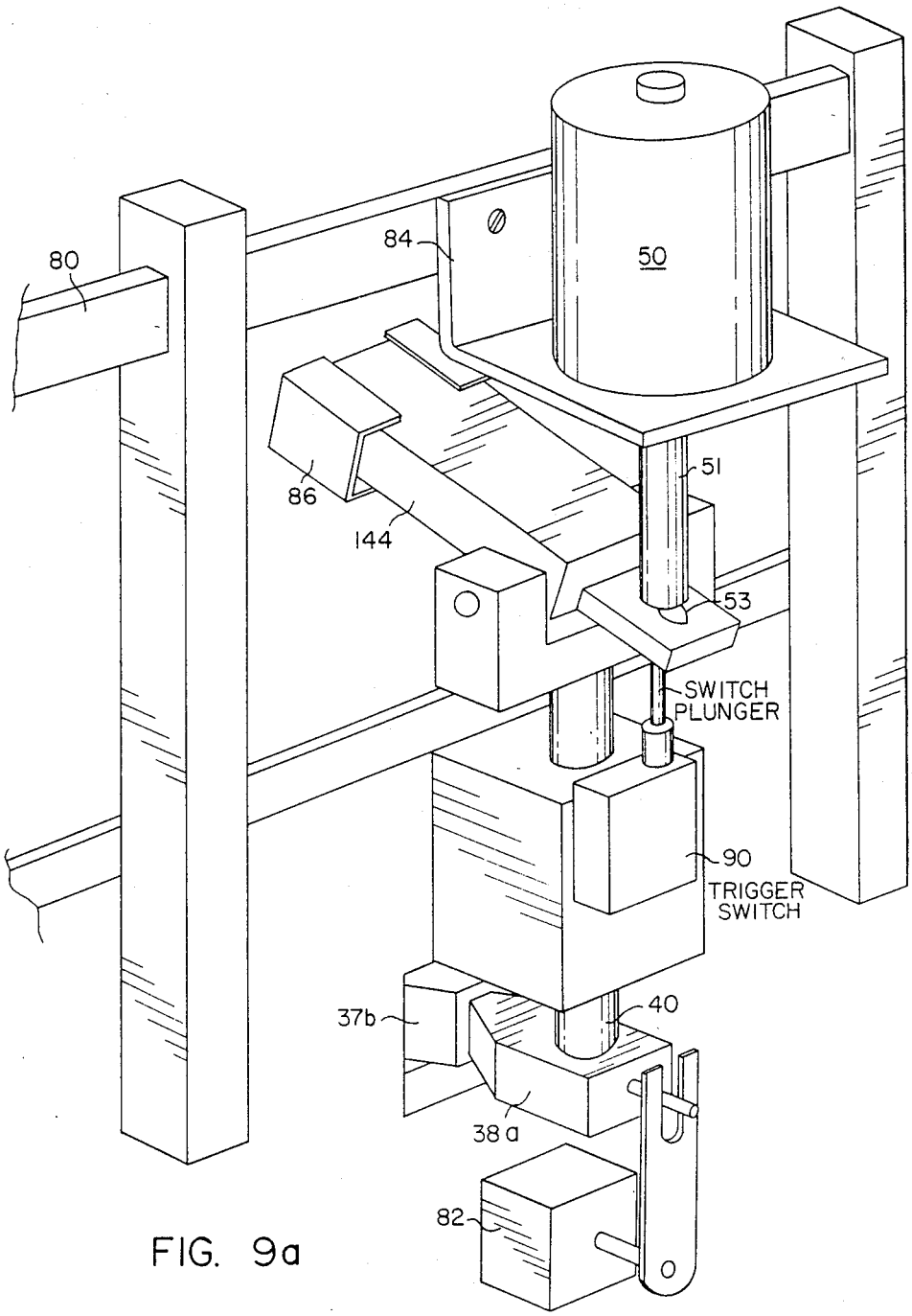
FIG. 9*a* is a perspective view of a modified version of the FIGS. 6–7 embodiment.

FIGS. 9a–9c illustrate a modification of the safety mechanism shown in FIGS. 6–7. The trigger solenoid 50 is attached by a bracket 84 to the solenoid support bar 80, which is mechanically engaged by the governor. The trigger 144 includes an anti-jamming device, in the form of a spacer clip 86 mounted on the end of the trigger so as to have a limited amount of horizontal play. The clip 86 is supported on the trigger 144 by a vertical pivot screw 85 and a pair of flanges 87, and is centered by a pair of light springs 88. This trigger assembly may be employed in the embodiments of FIGS. 1–5 as well.

If the trigger were to drop between two bosses but in very close proximity to one of the bosses, a subsequent change in load in the car could cause the sheave to rotate slightly because of gear backlash. This small motion might tend to jam the trigger against the side of the boss with enough force to prevent the solenoid from releasing it prior to the next run. The trigger assembly of FIGS. 9a–9c, however, will allow a limited amount, e.g., ⅛ inch, of lost motion between the trigger and the bosses with insignificant jamming force being produced. The solenoid would then only need to be designed to apply force sufficient to overcome the resistance produced by compression of one of the springs.

As shown in FIG. 9a, a trigger switch 90 is closed each time the trigger drops. The output signal of the trigger switch can be provided to the elevator logic controller to confirm that the trigger is properly armed. Failure to confirm proper operating of the trigger can be used to shut down the car at the top floor landing, where passengers will not be trapped, and a failure would not be serious because the car would have insufficient distance to accelerate since the counterweight is very close to the buffer.

Figure 10A:
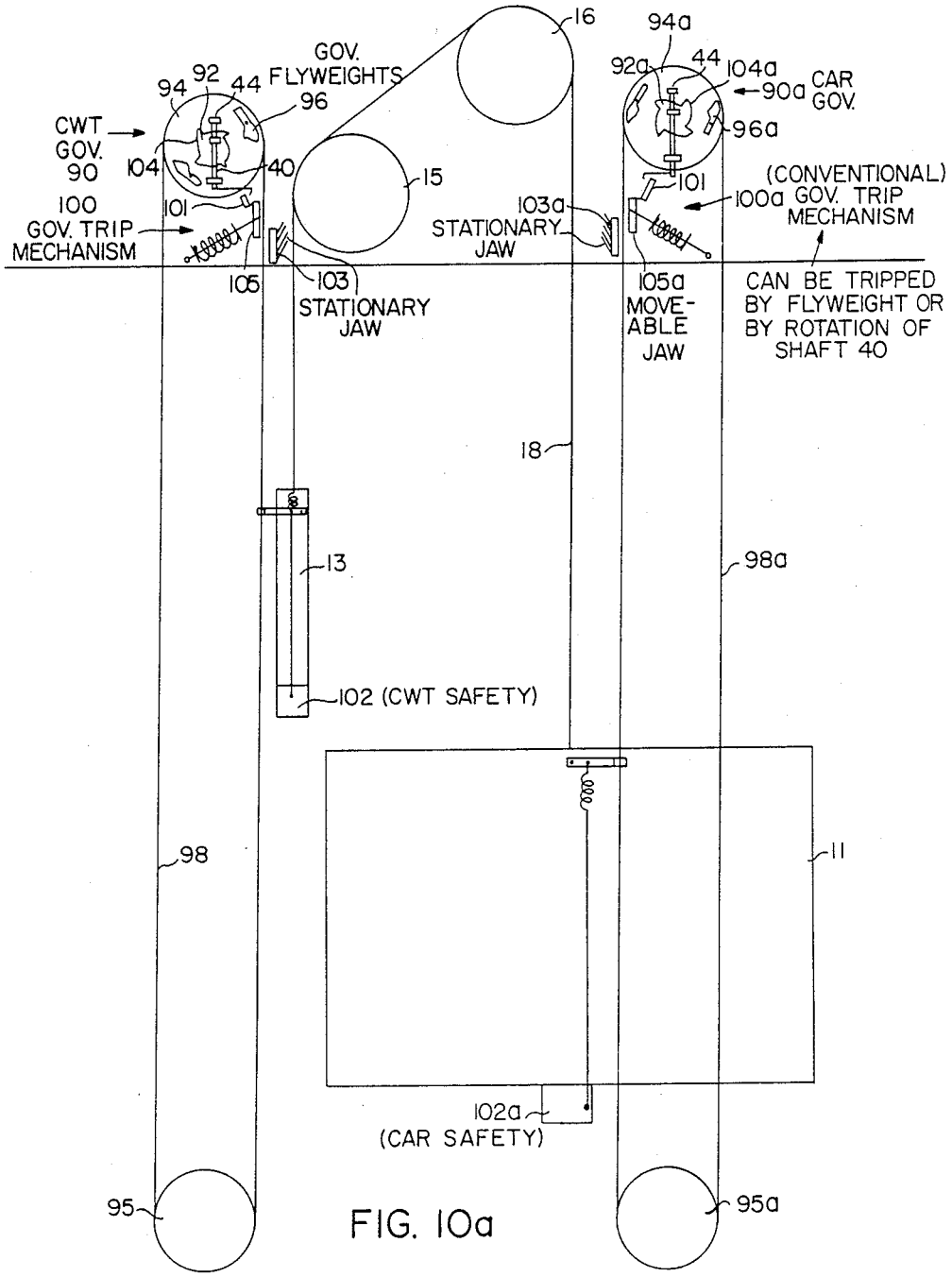
FIG. 10*a* is a side view of an elevator with a car and counterweight governor and safeties incorporating a fourth embodiment of the invention.
Figures 10B, 10C:
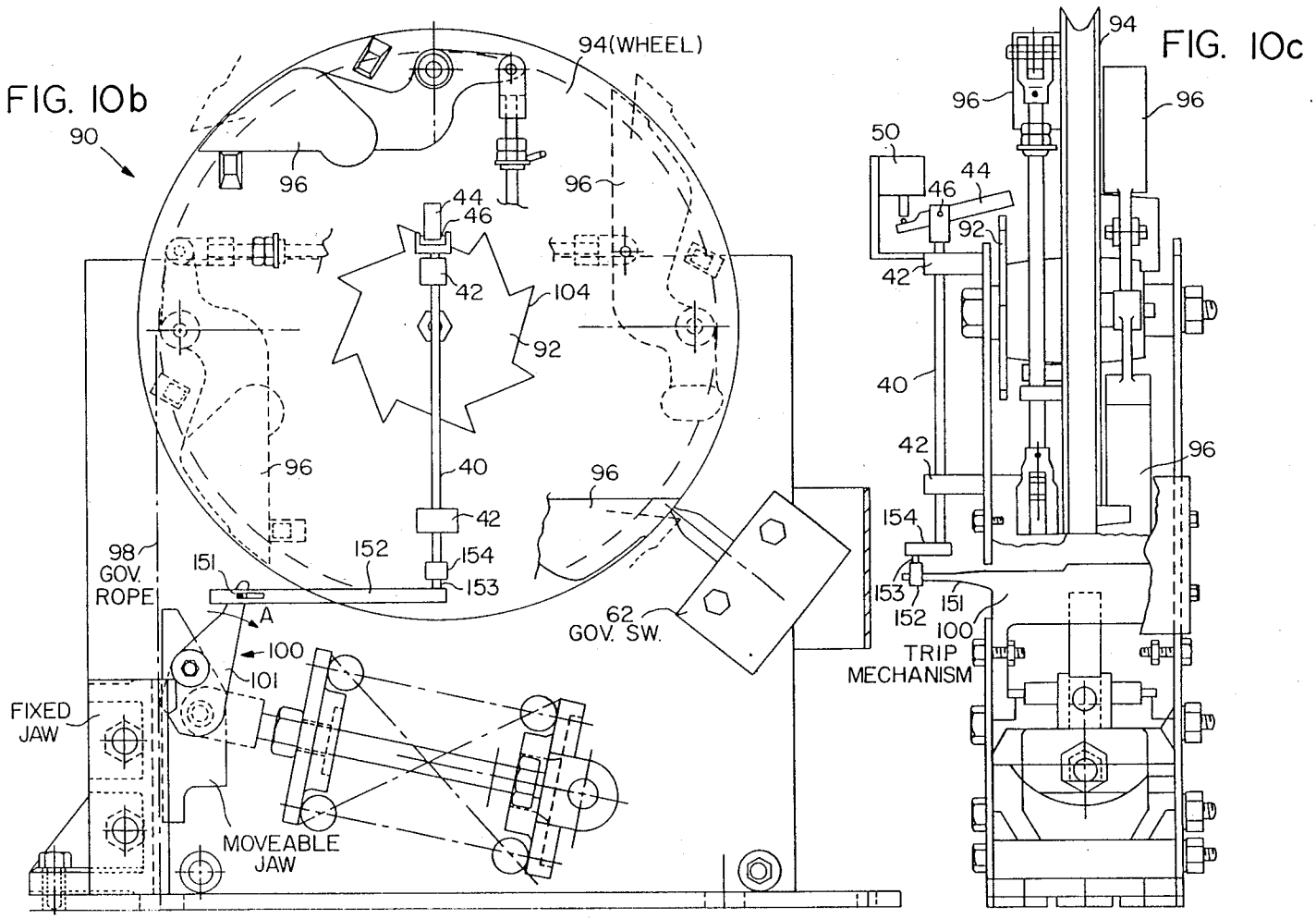
FIGS. 10*b* and 10*c* are partial side and front views, respectively, of the elevator governor system of FIG. 10*a*.

FIGS. 10a–10c disclose another embodiment of the invention, that operates in conjunction with the existing car safety and/or counterweight safety.

FIG. 10a illustrates a counterweight governor 90 which includes a sheave 92, a governor wheel 94, and flyweights 96. The governor wheel 94 is driven by cable 98 which is trained over a pulley 95 at the bottom of the shaft, and is attached to the counterweight 13, which includes a safety 102. A governor trip mechanism 100, which is actuated by flyweights 96 on overspeed, includes a stationary jaw 103 and a moveable jaw 105, which can be actuated by trip arm 101 to grab cable 98 to actuate the safety 102. Similarly, a car governor 90a includes a governor wheel 94a, flyweights 96a, a car-driven cable 98a which is trained over pulley 95a, and a car safety 102a. The foregoing elements are conventional and need not be described further.

As shown better in FIGS. 10b–10c, a plurality of bosses 104 are cast on the governor sheave 92, and are selectively engaged by a normally armed trigger 44. The trigger is selectively disarmed by a solenoid 50, and is pivotably mounted on a rod 40 connected to the trip arm 101 of the conventional trip mechanism 100 of the counterweight governor. The bosses are designed to engage the trigger in one direction only, i.e. the down direction of the counterweight. An extension 151 is formed on trip arm 101, which is connected, through link 152 and pivot 153, to arm 154 carried on the bottom end of shaft 40. Accordingly, when a boss 104 engages the trigger 44, and the shaft 40 is caused to rotate, the linkage 154, 153, 152, 151 causes trip arm 101 to rotate in the direction of arrow "A", tripping the governor in the same manner as the flyweights 96 would during overspeed. As shown in FIG. 10a, a similar safety mechanism is incorporated into the car safety, with corresponding elements designated by the letter "a". In the case of the car sheave 92a, the bosses 104a are oriented to engage the trigger only in the down direction of the car.

The embodiment of FIGS. 10a–10c is advantageous in that it makes use of existing expensive equipment, with the addition of a few economical extra parts.

Figure 11:
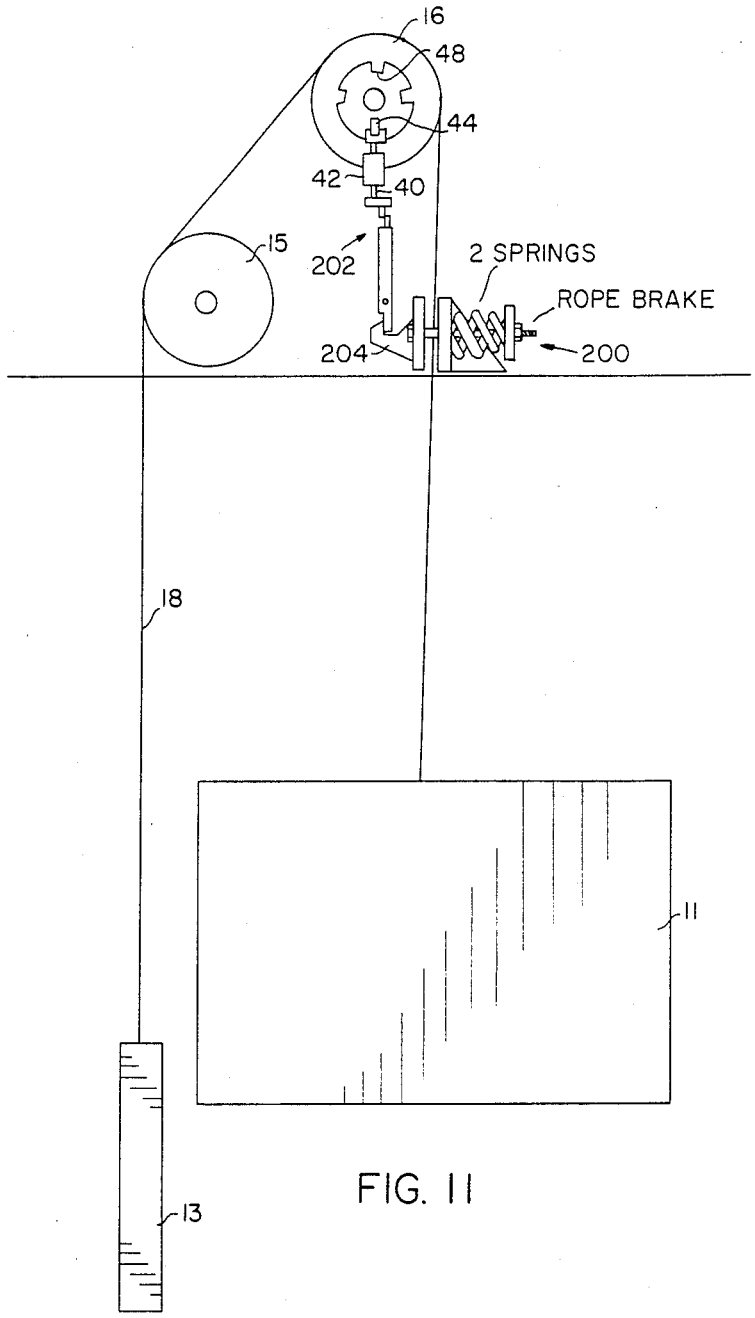
FIG. 11 is a side view of another embodiment of a safety mechanism according to the invention.

FIG. 11 shows a traction elevator which includes a rope brake 200 of the type generally known that, when tripped, clamps the hoist ropes 18 or compensating ropes. As shown, trigger 44, which rotates shaft 40 in bearing block 42, is coupled through a connecting linkage 202 to the trip mechanism 204 of the rope brake 200. The trigger mechanism 44, 40, 42, is selectively armed and operated in the same manner as in other embodiments.

The foregoing represents the preferred embodiments of the invention. Variations and modifications of the exemplary embodiments disclosed herein will be apparent to persons skilled in the art, without departing from the inventive principles disclosed herein. For example, while certain embodiments of the safety mechanism are actuated responsive to both overspeed and unintended car motion, the safety mechanism may be used for either function alone. All such modifications and variations are intended to be within the scope of the invention, as defined in the following claims.

I claim:

1. A traction elevator having a car, a counterweight, at least one sheave rotated responsive to motion of the car, a main friction brake for holding said car at landings and at least one additional emergency brake, mechanical catch means for holding said emergency brake in a disengaged position; and tripping means for tripping the catch means for actuating the emergency brake, wherein the tripping means comprise:

engagement means on said sheave for selectively engaging a trigger for moving the trigger along a first path responsive to sheave rotation;

a trigger moveable along said first path and also moveable along a second path between an armed position, for engaging said sheave, and a disarmed position out of engagement with said sheave;

coupling means between said trigger and said catch means for releasing said catch means responsive to trigger movement along said first path; and control means for selectivity moving said trigger between said armed position and said disarmed position responsive to at least one elevator operating condition.

2. A traction elevator as defined in claim 1, wherein the control means comprises means for urging said trigger toward a normally armed position, and solenoid means for selectively moving said trigger to said disarmed position when said solenoid is energized.

3. A traction elevator as defined in claim 2, including brake release means for selectively disengaging the main brake, and means for energizing said solenoid means responsive to actuation of the brake release means.

4. A traction elevator as defined in claim 3, comprising a governor means for detecting overspeed conditions, and wherein the control means includes means responsive to said governor means for de-energizing said solenoid means.

5. A traction elevator as defined in claim 3, wherein said brake release means comprises a main brake release circuit which is selectively energized to release the main brake, and wherein said solenoid means is wired in parallel with said main brake release circuit to be energized responsive to said main brake release means.

6. A traction elevator as defined in claim 5, comprising first time delay means for delaying the deenergization of the solenoid means, for a selected time increment, after de-energization of the brake release circuit.

7. A traction elevator as defined in claim 6, comprising a safety circuit means for detecting selected elevator faults and for de-energizing said brake release circuit responsive thereto, and second time delay means, responsive to actuation of said safety circuit, for delaying the de-energization of the solenoid means for an additional selected time increment.

8. A traction elevator as defined in claim 7, wherein said first time delay means comprises a series resistor and a first capacitor connected in parallel to said solenoid means, and wherein said second time delay means comprises a second capacitor and electrical connector means, actuated by said safety circuit means, for selectively connecting said second capacitor to said resistor in parallel to said first capacitor.

9. A traction elevator as defined in claim 5, comprising governor means for detecting overspeed conditions, and switch means responsive to said governor means, for de-energizing said solenoid means for arming said trigger.

10. A traction elevator as defined in claim 1, comprising governor means for detecting overspeed conditions, and wherein said control means is responsive to said governor means for moving said trigger to said armed position responsive to overspeed detection.

11. A traction elevator as defined in claim 1, wherein the engagement means on said sheave comprise a plurality of bosses; and wherein said trigger is pivotably moveable along said second path and urged by gravity toward said armed position.

12. A traction elevator as defined in claim 11, wherein the control means comprise solenoid means for selectively pivoting said trigger, responsive to energization of said solenoid, to said disarmed position.

13. A traction elevator as defined in claim 12, wherein said coupling means comprises a trigger shaft rotatable about a shaft axis; wherein said trigger is mounted on said trigger shaft in a torsion resistant manner and pivotably mounted about an axis perpendicular to said shaft axis, and wherein said catch means includes a cam fixed to said trigger shaft for rotation therewith.

14. A traction elevator as defined in claim 13, comprising spacer means positioned on said trigger for engaging said bosses and moveable for permitting lost motion between said trigger and bosses.

15. A traction elevator as defined in claim 2, comprising a governor means for detecting overspeed conditions, wherein said solenoid means is normally positioned at a first location for selectively engaging said trigger, and is moveable to a second location out of engagement with said trigger, and means responsive to said governor means for moving said solenoid to said second location.

16. A traction elevator as defined in claim 15, wherein said override means comprise a slider rod for supporting said solenoid means, and for moving with said solenoid means between said first and second positions, and wherein said governor means includes an actuator arm, and means on said drive sheave responsive to overspeed for moving said actuator arm into engagement with said slider rod for moving said slider rod to said second position.

17. A traction elevator as defined in claim 5, comprising a governor means for detecting overspeed conditions, and override means responsive to said governor means for mechanically arming said trigger.

18. A traction elevator as defined in claim 1, comprising a counterweight governor having a governor trip mechanism, said governor including said sheave, a safety which is actuated responsive to the tripping of said governor trip mechanism, wherein said safety includes said emergency brake, wherein said tripping means includes coupling means between said trigger and said governor trip mechanism and said engagement means comprises bosses for actuating said trigger in one direction of rotation only.

19. A traction elevator as defined in claim 1, comprising an elevator controller, and detector means for generating a signal responsive to arming of said trigger and for supply said signal to said controller.

20. A traction elevator as defined in claim 1, comprising a motor, an elevator controller, and detector means for generating a signal responsive to actuation of said trigger and for supplying said signal to said controller, wherein said controller includes means responsive to said signal for stopping said motor.

21. In a traction elevator having a car, a counterweight, a rotatable drive sheave, a plurality of ropes between said car and counterweight and reeved over said drive sheave, drive means for rotating said drive sheave, and a main friction brake coupled to said drive sheave for holding said car at landings, a safety mechanism for preventing unintended car motion comprising:

a spring-loaded, emergency brake means for engaging at least one surface of said drive sheave; said emergency brake means including a mechanical catch means for holding said emergency brake means out of engagement with said drive sheave; and a trigger release means for tripping said catch means for releasing said emergency brake means, said trigger release means comprising engagement means on said drive sheave for selectively engaging a trigger for moving the trigger along a first path responsive to sheave rotation; a trigger moveable along said first path and also moveable along a second path between an armed position, for engaging said drive sheave and a disarmed position, out of engagement with said drive sheave; coupling means between said trigger and said catch means for tripping said catch means responsive to trigger movement along said first path; and control means for moving said trigger to said armed position responsive to at least one elevator operating condition.

22. A traction elevator as defined in claim 21, wherein said emergency brake means comprises a pair of plates having brake pads for engaging opposing surfaces on said sheave, at least one spring for urging said brake pads toward their respective surfaces, and wherein said catch means includes a cam rotatable between a first position for holding said brake pads away from said surfaces and a second position for allowing said brake pads to engage said surface.

23. A traction elevator as defined in claim 22, wherein said drive sheave includes oppositely facing, axially spaced end faces, and wherein said brake pads are disposed on opposite sides of said end faces.

24. A traction elevator as defined in claim 22, when said drive sheave includes a disc, and said brake pads are disposed on opposite sides of said disc.

25. A traction elevator as defined in claim 22, comprising a bearing block on one plate, and wherein said trigger release means comprises a trigger shaft, having an axis, rotatably supported by said bearing block for rotation about its axis, wherein said trigger is mounted to said shaft in a torsion resistant manner, and is pivotably mounted to said shaft about a axis perpendicular to the shaft axis, and wherein said catch means includes a cam fixed to said shaft for rotation therewith.

26. A traction elevator as defined in claim 25, wherein said trigger is urged by gravity toward its armed position, and said solenoid is actuatable to pivot said trigger to its disarmed position.

27. A traction elevator as defined in claim 26, wherein said solenoid is normally positioned in a first location, for selectively engaging said trigger, and is moveable to a second location out of engagement with said trigger.

28. A traction elevator as defined in claim 27, comprising a governor means having mechanical engagement means for moving said solenoid to said second position responsive to overspeed conditions.

29. A traction elevator as defined in claim 26, wherein the engagement means on said drive sheave comprise a plurality of bosses.

30. A traction elevator as defined in claim 29, comprising spacer means positioned on said trigger for engaging said bosses and moveable for permitting lost motion between said trigger and said bosses.

31. In a traction elevator having a car, a counterweight, a governor including a sheave, rotated in response to counterweight movement, and a governor trip mechanism, and a counterweight safety actuated responsive to the tripping of said governor trip mechanism, a safety mechanism for preventing unintended car movement comprising:

at least one boss on said sheave;

a trigger moveable between an armed position, in the path of said boss, and a disarmed position, wherein said trigger is moved along a first path responsive to sheave rotation when in the armed position;

coupling means between said trigger and said governor tripping mechanism for actuating said tripping mechanism responsive to trigger movement along said first path; and means for moving said trigger to said unarmed position responsive to at least one elevator operating condition indicating that car movement is intended, and for moving said trigger to said armed position responsive to at least one operating condition indicating that car movement is not desired.

32. A traction elevator as defined in claim 31, wherein said sheave includes a plurality of bosses for engaging said trigger in one direction only.

33. A traction elevator as defined in claim 1, wherein said emergency brake comprises a rope brake having a tripping mechanism, said tripping mechanism constituting said catch means.

* * * * *